United States Patent [19]

Rayment

[11] 4,005,500

[45] Feb. 1, 1977

[54] FINISHING OF TEXTILES

[75] Inventor: John Rayment, Nottingham, England

[73] Assignee: Samuel Pegg & Son Limited, Leicester, England

[22] Filed: Mar. 26, 1974

[21] Appl. No.: 454,905

[30] Foreign Application Priority Data

Apr. 3, 1973 United Kingdom ..... 15806/73

[52] U.S. Cl. ..... 8/149.1; 8/149.3; 8/151.2; 8/152; 68/5 C; 68/22 R; 68/205 R

[51] Int. Cl. ..... B05c 5/00; B05c 9/08

[58] Field of Search ..... 8/149.1, 149.2, 149.3, 8/150, 151.1, 151.2, 152; 68/5 R, 5 A, 5 B, 5 C, 5 D, 5 E, 22 R, 62, 177, 178, 205 R

[56] References Cited

UNITED STATES PATENTS

| | | | |
|---|---|---|---|
| 1,403,126 | 1/1922 | Lyth | 8/152 |
| 2,532,471 | 12/1950 | Wedler | 68/5 D |
| 3,718,012 | 2/1973 | Vinas | 68/177 X |
| 3,762,866 | 10/1973 | Rayment et al. | 68/178 X |

FOREIGN PATENTS OR APPLICATIONS

| | | | |
|---|---|---|---|
| 1,785,141 | 12/1972 | Germany | 68/177 |
| 274,703 | 7/1927 | United Kingdom | 68/177 |

*Primary Examiner*—Harvey C. Hornsby
*Assistant Examiner*—Philip R. Coe
*Attorney, Agent, or Firm*—Larson, Taylor and Hinds

[57] ABSTRACT

The invention relates to a process of finishing textiles, for example treating them with a dyestuff, in which the textile is driven around a closed circuit. Progress of the textile may be assisted by contact with a driven roller but is at least partially advanced by the action of a flow of air under pressure impinging at an oblique angle on the textile while the treatment liquor is being applied and then by a flow of steam or steam and air impinging on the textile, which also raises the temperature to the fixing temperature of the dyestuff.

9 Claims, 3 Drawing Figures

FINISHING OF TEXTILES

BACKGROUND OF THE INVENTION

The present invention is concerned with the finishing of textiles, for example, piece-goods, yarn and made-up garments in a process which includes the step of impregnating the textile with a liquor comprising a solution, dispension or emulsion of a finishing agent in or with water and a fixing step in which the impregnated textile is heated to a temperature, herein referred to as "the fixing temperature", at which the finishing agent is fixed therein.

In U.S. Pat. No. 3,762,866, (Rayment et al.) there is described such a process wherein the liquor-impregnated textile is mechanically worked to form a foam of the liquor to wet-out the textile and then the textile is heated in an atmosphere which is at least substantially saturated with water vapour.

BRIEF SUMMARY OF INVENTION

It is an object of the present invention to improve the efficacy of such a process.

The invention provides a process for the treatment of textiles in a finishing stage of manufacture, in which the progress of the textile is in a path around a closed circuit within a treatment zone is achieved at least in part firstly by means of an air flow impinging obliquely upon the textile while the textile is being impregnated by a treatment liquor and then by means of a flow of steam under pressure impinging obliquely upon the impregnated textile whereby to raise the temperature thereof to the fixing temperature.

In the use of the process of the invention the liquor is found to be distributed evenly through the textile and the uniform controlled heating of the textile to the fixing temperature is achieved.

In a preferred embodiment, the process uses a ring element to supply liquor to the textile, the element being provided with openings through which liquor is sprayed.

The process may be operated under conditions of reduced or elevated pressure as required.

BRIEF DESCRIPTION OF DRAWINGS

There will now be described with reference to the accompanying drawings a machine in which the process of the invention may be carried out. The process is hereinafter described by way of example only. In the drawings.

DETAILED DESCRIPTION

Figure 1:
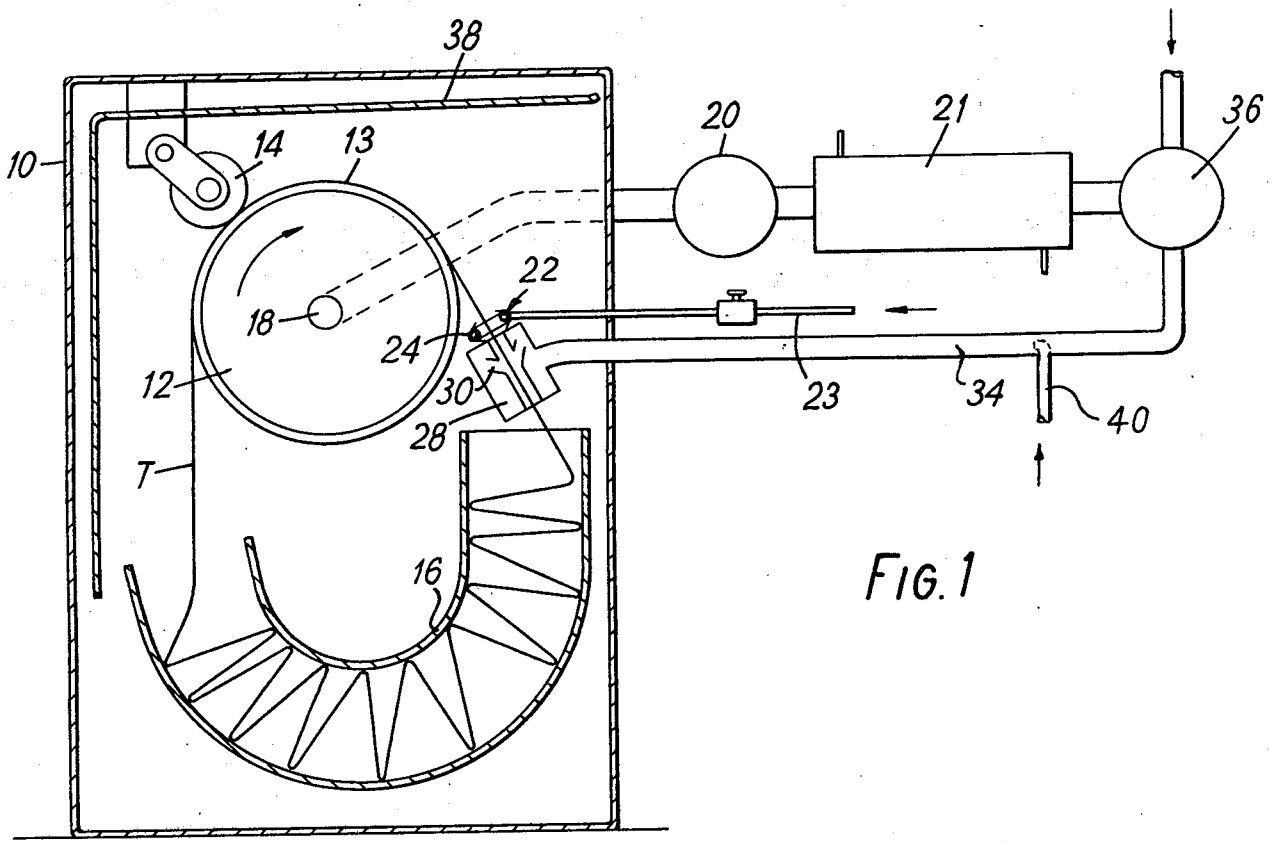
FIG. 1 is a diagrammatic sectional view of the above mentioned machine showing textiles being treated.

The process according to the invention is applied to one or a plurality of continuous flat web(s) or rope(s) of textile T which is contained within a casing 10 of the machine. The casing encloses a driven roller in the form of a rotatable drum 12 which assists in driving the textile through the machine. A secondary roller 14 for performing mechanical work on the textile as it is carried in contact with a surface 13 of the drum 12 is advantageously mounted for movement towards and away from said drum thus to adjust the nip therebetween.

The drum 12 is mounted on trunnions (not shown) in an upper part of the casing above a j-sectioned textile storage compartment 16, a hollow central spindle 18 of the drum 12 being connected to a fan 20 for exhausting the casing 10.

Figure 3:
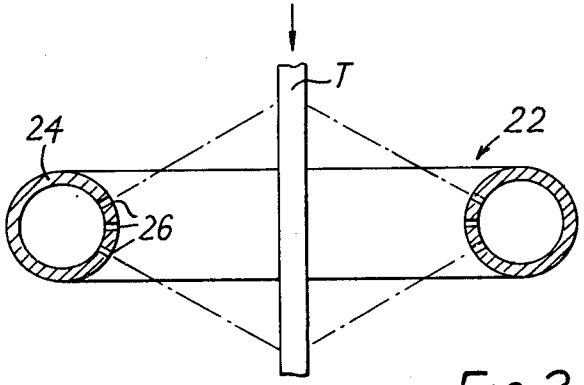
FIG. 3 is a sectional view showing details of the liquor supply means of the machine.

The machine includes liquor supply means 22 located in such a manner that it lies in the path of each or the textile T released from the surface 13 of said drum 12. The liquor supply means sprays processing liquor, in the present example, dye liquor, onto the surface of said textile as it passes through the liquor supply means which comprises a ring element 24 provided with inwardly facing openings 26, see FIG. 3, of size sufficient to provide a fine spray. The liquor supply means is connected to a supply conduit 23 for supplying dye liquor, a regulating valve being provided in the conduit 23 for adjustment of the liquor flow according to the textile being treated and the rate of feed of the textile.

The machine also comprises means for supplying steam under pressure whereby liquor applied to said textile may be worked to promote foaming thereof, prior to reaching a fixing stage in the cycle, said means being provided (see FIGS. 1 and 2) by a device 28 through which the textile passing from said drum 12 to said textile storage compartment 16 is arranged to pass.

The device 28 is generally of known construction and has an annular opening 30 arranged to project steam, or air and steam, towards said path of the textile passing from said drum 12 to the compartment 16, the annular opening 30 also being arranged that the fluid projected thereby inpinges on the textile at an acute angle to said path and assist, therefore, in maintaining the textile rope in said path while also assisting the progress of the textile towards said compartment.

Connected to the device 28 is a conduit 34 for supplying hot air and steam, or steam for assisting in processing the textile, the conduit being connected to a regulating valve 36 for controlling the flow of hot air/steam as required by the process being carried out on the textile.

The machine also is provided with a heat exchanger 21 connected between the fan 20 and the regulating valve 36 whereby air exhausted from the casing may be heated and recirculated.

The machine further comprises a condensate tray 38 located in an upper portion of the casing 10, the tray being arranged in such a manner that condensates are prevented from dripping onto the textile and causing 'spotting' of the textile. The machine is also provided with additional steam injection means whereby steam is caused to impinge on the machine surfaces to thus raise temperature of the machine and avoid condensation in zones other than that associated with the condensate tray.

When the machine is in use, textile fabric in rope form is loaded into the casing in any convenient manner and the drum rotated. Where the machine has been in constant use for any length of time, care must be taken to ensure that the temperature within the casing has not become sufficiently raised to cause premature fixing of the dyestuff. To this end, a pipe 40 is provided leading into the pipe 34 and through atomised water is caused to spray, to counteract the heating effect of the compressed air. Liquor is sprayed onto the textile passing through the liquor supply means 22, the liquor being in a fine spray and containing the dyestuff and a surfactant, in the present example a foam forming agent. Spraying of the treatment liquor continues for between 1 and 10 cycles of the length of textile in the machine to assist even and total wetting-out of the textile.

To assist in feeding the fabric and to promote the generation of foam, air may be supplied to the device 28.

When the textile is wetted out a mixture of air and steam, or steam only is introduced to the device 28 to cause the temperature of the wetted out textile to be raised rapidly to the fixation temperature of the dye liquor.

When the machine is in use passage of the textile between the drum 12 and the roller 14 may be used as desired to work the textile and therefore help to generate the foam. The 'nip' between the roller 14 and drum 12 is adjustable to give the most advantageous conditions for the textile under treatment.

The speed at which the textile will be circulated will vary with the conditions and particular material involved, but provision will be made to enable it to be moved at high speed, e.g. of the order of 100 metres per minute and even up to 300 metres per minute. This will ensure even temperature distribution at high rates of heating.

Figure 2:
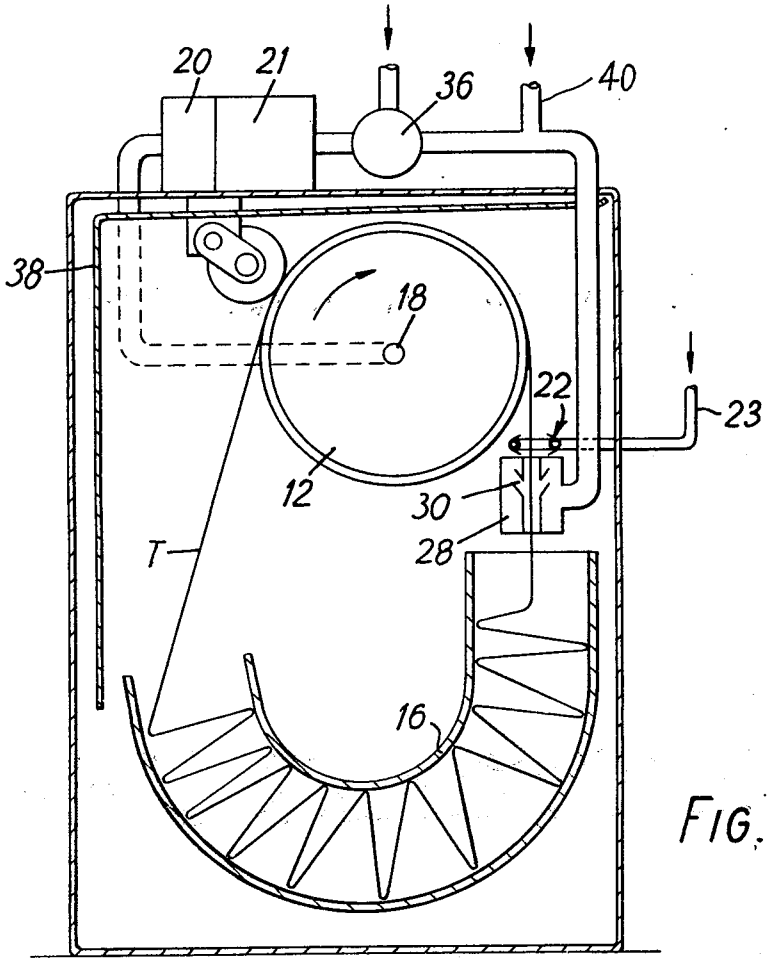
FIG. 2 is a similar view of a slightly modified arrangement of the machine.

The arrangement of FIG. 2 shows the use of the liquor supply means and fluid supply means when the path between the drum and storage compartment is vertical, or substantially so.

If necessary further additives can be sprayed onto the textile through the means 22.

Other arrangements are envisaged which fall within the scope of the present invention, for example, whereas the air and steam have been described herein as being fed through one jet of a jet means, the process may equally well be carried out by feeding the air and steam through independent jets of one jet means or separate jet means.

We claim:

1. A process for the treatment of textiles in a finishing stage of manufacture, in which the progress of the textile in a path around a closed circuit within a treatment zone is achieved at least in part firstly by means of an air flow impinging obliquely upon the textile while the textile is being impregnated by a treatment liquor and then by means of a flow of steam under pressure impinging obliquely upon the impregnated textile whereby to raise the temperature thereof to the fixing temperature.

2. A process in accordance with claim 1 wherein a spray of atomised water is provided in the treatment zone to keep the temperature in the treatment zone below the fixing temperature during the impregnation stage.

3. A process in accordance with claim 1 wherein the driving effect of the flow of steam on the textile is assisted by the addition of a flow of air.

4. A process in accordance with claim 1 wherein the liquor also contains a foaming agent.

5. A process in accordance with claim 4, wherein the progress of the textile is assisted by a driven roller and the action of the foaming agent is enhanced by trapping the textile between the driven roller and a secondary roller as the textile progresses in said path.

6. A process in accordance with claim 5 wherein the position of the secondary roller relative to the driven roller is adjustable.

7. A process in accordance with claim 1 wherein the liquor is applied to the textile from a spray device in the form of a ring through which the textile passes in its path around the closed circuit.

8. A process in accordance with claim 1 wherein the flow of steam is directed on to the textile from an annular nozzle through which the textile passes in its path around the closed circuit.

9. A process in accordance with claim 1 wherein the progress of the textile is assisted by a mechanical driving means in the form of a driven roller.

* * * * *